United States Patent [19]

Maierson

[11] Patent Number: 4,614,757

[45] Date of Patent: Sep. 30, 1986

[54] COLOR DEVELOPER FOR PRESSURE-SENSITIVE RECORDING PAPERS

[75] Inventor: Theodore Maierson, Dayton, Ohio

[73] Assignee: The Standard Register Company, Dayton, Ohio

[21] Appl. No.: 796,310

[22] Filed: Nov. 8, 1985

Related U.S. Application Data

[63] Continuation-in-part of Ser. No. 590,842, Mar. 19, 1984, Pat. No. 4,556,687.

[51] Int. Cl.[4] ..... B41M 5/16; B41M 5/22

[52] U.S. Cl. ..... 524/333; 524/171; 568/33; 428/341; 106/21; 346/212; 282/27.5

[58] Field of Search ..... 524/333, 171; 568/33; 428/341; 106/21; 346/212; 282/27.5

[56] References Cited

U.S. PATENT DOCUMENTS

| | | | |
|---|---|---|---|
| 3,244,550 | 4/1966 | Farnham et al. | 282/27.5 |
| 3,560,229 | 2/1971 | Farnham et al. | 106/21 |
| 3,834,929 | 9/1974 | Hayashi et al. | 346/210 |
| 4,089,547 | 5/1978 | Brynko et al. | 346/225 |
| 4,168,845 | 9/1979 | Oeda et al. | 346/209 |
| 4,203,619 | 5/1980 | Sanders | 106/14.5 |
| 4,219,220 | 8/1980 | Oda et al. | 106/21 |
| 4,260,179 | 4/1981 | Yamaguchi et al. | 106/21 |
| 4,262,938 | 4/1981 | Yamaguchi et al. | 106/21 |
| 4,264,365 | 4/1981 | Sanders | 106/14.5 |
| 4,268,069 | 5/1981 | Stolfo | 106/21 |
| 4,387,117 | 6/1983 | Shanton | 427/150 |
| 4,391,850 | 7/1983 | Shanton | 427/150 |
| 4,391,852 | 7/1983 | Nakamura et al. | 427/150 |
| 4,407,892 | 10/1983 | Yamaguchi et al. | 428/411 |
| 4,556,687 | 12/1985 | Maierson | 524/333 |

*Primary Examiner*—John Kight
*Assistant Examiner*—M. L. Moore
*Attorney, Agent, or Firm*—Jacox & Meckstroth

[57] ABSTRACT

A chelate of zinc with 4,4'-dihydroxydiphenyl sulfone is obtained in a solvent-free system for use as a color developer in carbonless copy paper systems. The 4,4'-dihydroxydiphenyl sulfone is solubilized in an aqueous medium by reacting with a water-soluble amine. A mineral matrix is then added followed by the addition of a zinc halide, preferably zinc bromide, to cause the chelate of zinc with 4,4'-dihydroxydiphenyl sulfone onto and within the structure of the mineral matrix. After removal of any excess zinc cations, and addition of any desired fillers, a binder is added and the composition coated onto the substrate.

10 Claims, No Drawings

COLOR DEVELOPER FOR PRESSURE-SENSITIVE RECORDING PAPERS

CROSS-REFERENCE TO RELATED APPLICATION

The present application is a continuation-in-part of U.S. application Ser. No. 590,842, filed on 3-19-84, now U.S. Pat. No. 4,556,687 the entire contents of which are hereby incorporated by reference.

FIELD OF THE INVENTION

The present invention relates to novel organic solvent-free color developer compositions for use in carbonless copy papers which will produce a stable intense mark when placed in contact with colorless dye precursors, and which are not subject to yellowing. The present invention also relates to coating compositions and record material sheets which contain such novel color developers, as well as to methods for producing such record material sheets without the use of organic solvents.

BACKGROUND OF THE INVENTION

In the manufacture of pressure-sensitive recording papers, better known as carbonless copy papers, a layer of pressure-rupturable microcapsules containing a solution of colorless dyestuff precursor is normally coated on the back side of the front sheet of paper of a carbonless copy paper set. This coated backside is known as the CB coating. In order to develop an image or copy, the CB coating must be mated with a paper containing a coating of suitable color developer, also known as dyestuff acceptor, on its front. This coated front color developer coating is called the CF coating. The color developer is a material, usually acidic, capable of forming the color of the dyestuff by reaction with the dyestuff precursor. Marking of the pressure-sensitive recording papers is effected by rupturing the capsules in the CB coating by means of pressure to cause the dyestuff precursor solution to be exuded onto the front of the mated sheet below it. The colorless or slightly colored dyestuff, or dyestuff precursor, then reacts with the color developer in the areas at which pressure was applied, thereby effecting the colored marking. Such mechanism or the producing technique of pressure-sensitive recording papers is well known.

Among the well-known basic, reactive, colorless, chromogenic dye precursors conventionally used in such carbonless copy paper systems, include those belonging to the classes of phthalides, fluoranes, spiropyranes, azomethines triarylmethaneleuco dyes, of the substituted phenoxazines or phenothiazines, and of the chromeno or chromane color formers. Examples of such suitable color precursors are: crystal violet lactone, 3,3-(bisamino-phenyl)-phthalides, 3,3-(bisubstituted indolyl)-phthalides, 3-(aminophenyl)-3-indolylphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or 3-lower alkylfluoranes, 6-dialkylamino-2-dibenzylaminofluoranes, 6-dialkylamino-2-dibenzylaminofluoranes, 6-diethylamino-1,3-dimethylfluoranes, the lactonexanthenes, the leucoauramines, the 2-(omega substituted vinylene)-3,3-disubstituted-3-1-1-indoles, 1,3,3-trialkylindolinospirans, bis-(aminophenyl)-furyl, phenyl- or carbazolylmethanes, or benzoyl-leucomethylene blue.

Known color developers for use in such recording papers have included:

(1) novolac phenolic resins made by acid catalyzed condensation of phenol, resorcinol, pyrogallol, cresols, xylenols, or alkyl phenols, such as p-tertiary butyl phenol, with aldehydes such as formaldehyde, acetaldehyde, benzaldehyde and butyraldehyde;

(2) metal salts of aromatic carboxylic acids with an OH group at the ortho position, such as zinc salts of salicylic acid, 3,5-di-tert-butyl salicylic acid, octyl salcylic acid, and 1-hydroxy-2-naphthoic acid, and (3) acid-treated clays such as kaolinites and attapulgites.

One of the disadvantages of the use of traditional phenolic resins, such as novolac-type resins, including the zinc salts of such resins and halogen-substituted resins, is the characteristic of yellowing during storage. Thus, the search has continued for other developers, particularly those having the advantages of phenolic-type resins, having high developing power, rapid developing speed, good light resistance, and time stability without yellowing. Another disadvantage of common phenolic developers is the adverse affect thereon by solvents or solvent vapors.

The compound 4,4'-sulfonyl diphenol (hereinafter SDP) has been listed as a possible color developer in, for example, U.S. Pat. Nos. 3,244,550, and 3,560,229, both to Farnham et al. Sulfonyl diphenol is also mentioned in U.S. Pat. Nos. 4,264,365 and 4,203,619 to Sanders. Hayashi et al, U.S. Pat. No. 3,834,929 discloses metal phenolates in which the phenol compound used to form the metal phenolate may be 4,4'-dihydroxy-3,3'-dichloro (or 3,3',5,5'-tetrachloro)diphenyl sulfone. Furthermore, Yamaguchi et al, U.S. Pat. No. 4,260,179, disclose 2,2'-bisphenolsulfone zinc salts. The use of 4,4'-dihydroxy-diphenyl sulfone as a color developer in CF coating systems has not achieved commercial acceptance, however, as, while SDP will modestly react with most leuco dyestuffs if properly handled, its sensitivity is affected by deposition conditions, and it is not easily adaptable as a single-component CF reactant.

In parent application Ser. No. 790,842, a zinc chelate of 4,4'-dihydroxydiphenyl sulfone is disclosed which solves the problems of the prior art discussed hereinabove. In the technology discribed in said parent application, 4,4'-dihydroxydiphenyl sulfone is solubilized in aqueous media by use of water-soluble organic solvents after which a zinc halide is added to form a soluble chelate. After addition of carrier pigments, styrene-methacrylic acid emulsion and a latex binder, the composition is coated onto paper and the composition solvent evaporated to dryness.

This technology has the disadvantage of the required use of organic solvents to solubilize the 4,4'-dihydroxydiphenyl sulfone, the cost of such solvents and environmental restrictions when solvents are used commerically, makes this process disadvantageous. A process for applying a zinc chelate of 4,4'-dihydroxydiphenyl sulfone without the use of an organic solvent would therefore be desirable.

SUMMARY OF THE INVENTION

Accordingly, it is an object of the present invention to provide a developer for use in carbonless copy paper systems which eliminates the deficiencies of the prior art.

It is another object of the present invention to provide an improved developer system for use in pressure-sensitive recording papers.

It is still another object of the present invention to provide improved coating compositions for use in making coated front record sheets in pressure-sensitive carbonless copy paper systems.

It is a further object of the present invention to provide such a coating composition which is organic solvent-free.

It is yet another object of the present invention to provide an improved record sheet coated with such an improved coating composition.

It is still a further object of the present invention to provide an improved method for producing a carbonless record sheet permitting the deposition of the zinc chelate of 4,4'-dihydroxydiphenyl sulfone without the use of an organic solvent.

It is still another object of the present invention to provide a novel intermediate which permits a zinc chelate of 4,4'-dihydroxydiphenyl sulfone to be formed without the use of organic solvent.

These and other objects of the present invention are obtained by means of the novel color developer and developing systems of the present invention, wherein the primary color developer is the chelate with zinc of 4,4'-dihydroxydiphenyl sulfone. The 4,4'-dihydroxydiphenyl sulfone (sulfonyl diphenol) portion of the chelate of the present invention is hereinafter referred to as "SDP". The zinc chelate of SDP is formed by first solubilizing SDP in an aqueous medium by the addition of a water-soluble amine, then, after the addition of an inorganic mineral matrix, a zinc halide is added to initiate the formation of the chelate with SDP which then deposits itself on the surface of the inorganic mineral matrix, as well as within the structure thereof. The activity of the zinc chelate of SDP is enhanced by the adsorption of the chelate onto the mineral matrix within the coating composition, particularly when the matrix is a synthetic sodium aluminosilicate. A suitable binder may also be used in order to make the CF coating composition.

DETAILED DESCRIPTION OF PREFERRED EMBODIMENTS

While SDP has been disclosed to be useful as a color developer in CF coating systems, it is highly sensitive and affected by deposition conditions. Furthermore, it is not easily adaptable as a single component CF reactant. It has unexpectedly been found that the zinc chelate of the 4,4'-SDP displays a reactivity toward dye precursors commonly used in carbonless copy paper systems which is markedly improved over that of SDP. Chelation of SDP with a zinc halide stongly enhances the imaging reactivity of SDP without adversely affecting the solubility characteristics. The zinc-SDP complex of the present invention is distinguished from the zincated phenolics of the prior art insofar as the present complex is a true chelate, rather than an addition compound, such as the zinc phenolates described in U.S. Pat. No. 3,824,929 to Hayashi et al. Furthermore, the 4,4'-dihydroxydiphenyl sulfone zinc complex is a substantially different compound from the 2,2'-dihydroxysulfone zinc salt of the Yamaguchi U.S. Pat. No. 4,260,179. The 4,4'-bisphenol sulfone compound cannot make a salt in the same manner as the 2,2'-compound.

SDP is insoluble in water and will not chelate with zinc bromide unless fully solubilized. In accordance with the present invention, the SDP is solubilized by formation of an amine salt of SDP. Any water-soluble amine can be used for this purpose, including ammonia. For the purpose of the present invention, the terminology "water-soluble amine" as used in the present specification and claims, is intended to include ammonia or ammonium hydroxide. Among the other water-soluble amines which can be used for this purpose, are monoethanol amine, diethanol amine, triethanol amine, and aminomethyl-propanol-1.

Parent application Ser. No. 590,842 discloses that the reactivity of the chelate is enhanced by adsorption onto a mineral matrix. While the mineral matrix is preferably sodium aluminosilicate, it may alternatively be an acid clay (e.g., Silton), an attapulgite clay, hydrated alumina, silica, or a zeolite. Synthetic sodium aluminasilicates (e.g. HYDREX or ZEOLEX, both available from J. M. Huber Co.) in particular enhance the activity of Zn-SDP chelate, apparently by promoting some desirable precipitation within the matrix interstices.

In accordance with the present invention, the zinc SDP is deposited onto the mineral matrix directly from the aqueous solution rather than at the time of drying of the coating after if has been applied to the paper. This is accomplished by adding the matrix to the aqueous solution of the amine salt of SDP and then adding the zinc halide which initiates the formation of the chelate with SDP which then deposits itself on the surface of the mineral matrix as well as within the structure thereof.

While any zinc halide may be used as chelant, zinc bromide is preferred. Zinc chloride does not promote reactivity of SDP to the extent that zinc bromide does, and zinc chloride is known to cause corrosion in paper-handing equipment.

The amount of zinc halide which is added should be substantially stoichiometric. However, a small excess of zinc forces the chelation reaction to proceed further and is therefore preferred. To avoid the loss of adhesive effects of the binder which may be caused by an excess of zinc, polyvinyl alcohol may be added to complex with the free zinc cations. Alternatively, another sequestering agent, such as NaEDTA may be added just prior to the addition of the binder.

Conventional additives, such as colloidal alumina, colloidal silica, synthetic silica, barium sulfate, titanium dioxide, and other cosmetic materials may be included. Preferred additives in the CF coating composition of the present invention are talc, kaolin or synthetic silica. In this context, both talc and kaolin function as extenders, promoting the activity of the synthetic sodium aluminosilicate, and imparting a desirable "feel" to the coating. Kaolin, in a proportion of about 5 parts of aluminosilicate to about 2 parts of kaolin, is especially preferred. The additives may be added either prior to addition of the zinc halide or after the chelation step. Excellent results are obtained when calcined kaolin is added to the sodium aluminosilicate prior to the addition of the zinc halide.

After deposition of the chelated SDP onto the surface of the mineral matrix, other mineral fillers may be added to promote a more homogeneous coating composition by balancing the particle geometry.

The operable amounts of each of the components of the present composition are easily determinable by those skilled in the art, particularly in view of the optimum amounts set forth in the following examples. Preferably, for each part of the zinc-SDP chelate used, about 1–5 parts of mineral matrix should be used.

The color developer system of the present invention may be used with any of the color precursors known to the art, such as those listed hereinabove in the background of the invention.

The following examples illustrate the practice of the present invention.

EXAMPLE 1

To 140 g $H_2O$ there is added 4.2 g SDP and 1.3 g monoethanol amine. The solution is heated to 70° C. and sodium aluminosilicate (ZEOLEX) is added along with 10 g calcined kaolin. The composition is allowed to return to room temperature (½ hour) and 7.5 g zinc bromide (77%) is slowly added followed by 40 g gypsum, 15 g polyvinyl alcohol (20% Vinol 205 (Air Products Corp.)) and 20 g polyvinyl acetate terpolymer emulsion 50% solids (Union Oil Company).

The mixture is stirred to develop a homogeneous coating composition.

EXAMPLE 2

The coating composition prepared according to example 1 is applied as an aqueous system to one side of a substrate comprising a support sheet, in a conventional manner, to form a CF coating. The support sheet is a paper substrate and the coating is made in the range of 1–1.5 lb/ream of 17"×22" paper. A substrate having a conventional CB coating having microencapsulated leuco dyestuffs is juxtaposed with the CF coating, and the capsules ruptured in a pattern to transfer the dyestuff to the CF coating. An excellent image of the pattern is obtained.

While the above composition has been described for use in a pressure-sensitive copy paper system, it should be understood that the developer could be formulated for use in a heat-sensitive recording paper system, as will be understood by those skilled in the art.

It will be further obvious to those skilled in the art that various other changes may be made without departing from the scope of the invention, and the invention is not to be considered limited to what is described in the specification.

What is claimed is:

1. An aqueous solution of a salt of a water soluble amine with 4,4'-dihydroxydiphenyl sulfone.

2. A solution in accordance with claim 1, wherein said amine is ammonium hydroxide, monoethanol amine, diethanol amine, triethanol amine or aminomethyl propanol.

3. A color developer composition comprising an aqueous suspension of a mineral matrix having deposited thereon a zinc chelate of 4,4'-dihydroxydiphenyl sulfone.

4. A composition in accordance with claim 3, wherein said mineral matrix is a synthetic sodium aluminosilicate.

5. A composition in accordance with claim 3, wherein the chelate is the chelation product of zinc bromide and 4,4'-dihydroxydiphenyl sulfone.

6. A coating composition for carbonless record sheets comprising the developer composition in accordance with claim 3 and a binder.

7. A coating composition in accordance with claim 6, wherein said mineral matrix is a synthetic sodium aluminosilicate.

8. A coating composition in accordance with claim 6, wherein said chelate is the chelation product of a zinc halide and 4,4'-dihydroxydiphenyl sulfone.

9. A coating composition in accordance with claim 8, wherein said zinc halide is a zinc bromide.

10. A coating composition in accordance with claim 6, wherein said binder is a styrene-butadiene latex or a vinyl acetate emulsion terpolymer.

* * * * *